US010178918B2

(12) United States Patent
Rasch

(10) Patent No.: US 10,178,918 B2
(45) Date of Patent: Jan. 15, 2019

(54) ANTI-FOG HEAT CONTROL FOR A REFRIGERATED MERCHANDISER

(71) Applicant: Hussmann Corporation, St. Louis, MO (US)

(72) Inventor: John M. Rasch, St. Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 548 days.

(21) Appl. No.: 13/794,961

(22) Filed: Mar. 12, 2013

(65) Prior Publication Data

US 2014/0260360 A1 Sep. 18, 2014

(51) Int. Cl.

| | |
|---|---|
| ***A47F 3/04*** | (2006.01) |
| ***F25D 21/08*** | (2006.01) |
| ***H05B 3/84*** | (2006.01) |
| *F25D 23/02* | (2006.01) |

(52) U.S. Cl.

CPC ..... *A47F 3/0478* (2013.01); *F25D 21/08* (2013.01); *H05B 3/84* (2013.01); *A47F 3/0434* (2013.01); *F25B 2700/21172* (2013.01); *F25B 2700/21173* (2013.01); *F25D 23/02* (2013.01); *H05B 2203/013* (2013.01)

(58) Field of Classification Search

CPC ..... F25D 21/04; F25D 21/08; F25D 2400/02; H05B 3/84; H05B 1/0236; H05B 2203/035; A47F 3/0434

USPC ..... 62/80, 150, 248

See application file for complete search history.

(56) References Cited

U.S. PATENT DOCUMENTS

| | | | | |
|---|---|---|---|---|
| 3,692,100 | A * | 9/1972 | Gallagher, Jr. | B65D 88/745 165/256 |
| 3,859,502 | A | 1/1975 | Heaney | |
| 4,127,765 | A | 11/1978 | Heaney | |
| 4,750,335 | A * | 6/1988 | Wallace | F25D 21/04 62/248 |
| 5,778,689 | A | 7/1998 | Beatenbough | |
| 5,852,284 | A | 12/1998 | Teder et al. | |
| 5,899,078 | A * | 5/1999 | Mager | 62/80 |
| 6,378,324 | B1 * | 4/2002 | Percy | F25D 19/02 221/150 R |
| 6,627,851 | B2 | 9/2003 | Sangwan et al. | |

(Continued)

FOREIGN PATENT DOCUMENTS

| | | |
|---|---|---|
| DE | 3241622 | 5/1984 |
| EP | 0260662 | 3/1988 |

(Continued)

*Primary Examiner* — Filip Zec

(74) *Attorney, Agent, or Firm* — Michael Best & Friedrich LLP

(57) ABSTRACT

A refrigerated merchandiser includes a sensor coupled to a case adjacent an air inlet. The sensor is in communication with a portion of a refrigerated airflow passing through the air inlet to sense a temperature of the airflow and to generate a signal indicative of an air return temperature. The merchandiser also includes a controller in communication with the sensor to receive the signal indicative of the air return temperature, the controller further in communication with a conductive film on a door and programmed to initiate a clearing interval to clear condensation from the door in response to the signal indicative of the air return temperature reaching a first predetermined temperature threshold.

18 Claims, 4 Drawing Sheets

(56) References Cited

U.S. PATENT DOCUMENTS

| | | | | |
|---|---|---|---|---|
| 7,207,181 | B2 * | 4/2007 | Murray et al. | 62/150 |
| 7,240,501 | B2 | 7/2007 | Bunch et al. | |
| 7,367,198 | B2 * | 5/2008 | Behr | A47F 3/0443 62/208 |
| 7,421,847 | B2 | 9/2008 | Murray et al. | |
| 7,905,101 | B2 | 3/2011 | Sunderland et al. | |
| 8,136,363 | B2 * | 3/2012 | Ludwig | B60H 1/00014 62/150 |
| 8,140,185 | B2 * | 3/2012 | Simmons | G07F 9/026 700/236 |
| 8,539,783 | B1 * | 9/2013 | Bunch | 62/154 |
| 2007/0235549 | A1 * | 10/2007 | Nakajima | B60H 1/00785 236/44 R |
| 2008/0115519 | A1 | 5/2008 | Vogh, III | |
| 2012/0170120 | A1 * | 7/2012 | Lee | H05B 3/84 359/512 |

FOREIGN PATENT DOCUMENTS

| | | |
|---|---|---|
| EP | 1275919 | 7/2001 |
| JP | 11073552 | 3/1999 |

* cited by examiner

ANTI-FOG HEAT CONTROL FOR A REFRIGERATED MERCHANDISER

BACKGROUND

The present invention relates to refrigerated merchandisers, and specifically to anti-fog heat control for doors on refrigerated merchandisers.

Refrigerated merchandisers generally include a case defining a product display area for supporting and displaying food products to be visible and accessible through an opening in the front of the case. Refrigerated merchandisers are generally used in retail food store applications such as grocery or convenient stores or other locations where food product is displayed in a refrigerated condition. Some refrigerated merchandisers include doors to enclose the product display area of the case and reduce the amount of cold air released into the surrounding environment. The doors typically include one or more glass panels that allow a consumer to view the food products stored inside the case.

Existing refrigerated merchandisers display fresh and frozen food product in a product display area, and include glass doors to provide visibility of the food product and product accessibility to consumers. Often, condensed moisture accumulates on the exterior surface of the cold glass, which obscures viewing of the product in the merchandiser. The moisture in the relatively warm ambient air of the store can condense on the outside surface of the glass door. Similarly, moisture can condense on the cold inside surface of the glass door when the door is opened. Without heating, the condensation on the outside and inside of the glass door does not clear quickly and obscures the food product in the merchandiser. Long periods of obscured food product caused by condensation may detrimentally impact sales of the food product.

In doors with a single glass panel, condensation typically forms on the outer surface of the glass panel due to the cool outer surface being in communication with the ambient environment. In addition, fog often forms on the inner surface the glass panel due to the inner surface generally being in communication with the relatively cold product display area and then being exposed to the relatively humid air of the ambient environment when the door is opened. In doors with multiple glass panels (e.g. three glass panels), emissivity coatings along the panels inhibit heat transfer through the panels, thereby keeping the outer-most glass panel (i.e. the panel exposed to the ambient environment) warmer than the inner-most glass panel (i.e. the panel exposed to the product display area). In these multi-panel doors, condensation is less likely to occur on the warmer outer-most glass panel, but is still likely to occur on the colder inner-most glass panel when the door is opened.

Some glass doors include a resistive coating or semi-conductive film (e.g., tin-oxide) adhered or affixed to the glass door to remove condensation and fog. The resistive coating supplies heat to the glass door via current flow through the coating caused by a supply of electrical potential or electricity from the merchandiser. Typically, the heat applied to the glass door is controlled by a controller based on a duty cycle. These duty cycles are varied between an "on" state (i.e. heat applied to the glass door) and "off" state to regulate the time that heat is applied to the glass door, and are generally defined by the percentage of time that the duty cycle is in the "on" state. However, existing control systems regulate heat applied to glass doors based on a predetermined duty cycle that supplies electrical potential to the glass door based on the predetermined time that the duty cycle is in the "on" state. The time that the duty cycle is in the "on" state is regulated to limit energy use by the merchandiser. Once the duty cycle enters the "off" state, no electrical potential is supplied to the glass door. When the glass door is opened during the predetermined time that the duty cycle is in the "off" state, condensation may readily form on the interior and/or exterior of the glass door.

Conventional control systems cannot eliminate condensation that forms on the glass door when the duty cycle is in the "off" state. Instead, heat is applied to the glass door to remove condensation only when the duty cycle is in the "on" state. As such, the duty cycle regulated by conventional control systems can adversely affect elimination of condensation from the glass door due to a relatively long period of time between the glass door being opened and the duty cycle entering the "on" state. The inability of existing control systems to actively remove condensation from glass doors in response to formation of condensation allows condensation to remain on the glass doors for a long time, and detrimentally impacts the viewability of the food product.

Similarly, conventional control systems cannot compensate for multiple door openings that occur in a relatively short period of time to adequately clear condensation and fog from the glass doors. For example, when multiple door openings occur and the duty cycle is in the "off" state (i.e. no heat applied to the glass door), condensation can accumulate on the glass door. The condensation is not removed by the control system until the duty cycle enters the "on" state. Depending on the duty cycle, a relatively long period of time can elapse between the last of the multiple door openings and entry of the duty cycle into the "on" state. As a result, the glass door can remain obscured by condensation for a relatively long time.

SUMMARY

In one construction, the invention provides a refrigerated merchandiser including a case defining a product display area and including a base having an air inlet located adjacent the product display area and a canopy disposed substantially above the product display area, the canopy having an air outlet located adjacent the product display area, the case including a mullion defining an opening in communication with the product display area. The merchandiser also includes a door coupled to the case over the opening to provide access to the product display area and to substantially enclose the product display area, the door including a glass member having a conductive film. The merchandiser also includes a passageway fluidly connecting the air inlet with the air outlet to direct a refrigerated airflow from the air outlet across the opening and generally toward the air inlet. The merchandiser also includes a sensor coupled to the case adjacent the air inlet and in communication with a portion of the refrigerated airflow passing through the air inlet to sense a temperature of the airflow and to generate a signal indicative of an air return temperature. The merchandiser also includes a controller in communication with the sensor to receive the signal indicative of the air return temperature, the controller further in communication with the conductive film and programmed to initiate a clearing interval to clear condensation from the door in response to the signal indicative of the air return temperature reaching a first predetermined temperature threshold.

In another construction, the invention provides a method of operating a refrigerated merchandiser including a case defining a product display area, and at least one door providing access to the product display area, the method including sensing an air return temperature inside of the case, generating a signal indicative of the air return temperature, determining whether the signal is indicative of the air return temperature reaching a first predetermined temperature threshold, and initiating a clearing interval to clear condensation from the door in response to the signal indicating that the air return temperature has reached the first predetermined temperature threshold.

In another construction, the invention provides a method of operating a refrigerated merchandiser including a case defining a product display area, and at least one door providing access to the product display area, the method including sensing an air return temperature, delivering a signal indicative of the sensed air return temperature to a controller, determining whether the air return temperature has reached a first predetermined temperature threshold, raising a temperature of the door to a glass temperature threshold within a specified timeframe in response to sensing that the air return temperature has reached the first predetermined temperature threshold, and reducing a level of heat applied to the door to hold the temperature of the door at the glass threshold temperature until the air return temperature has decreased beyond a second predetermined temperature threshold.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

DETAILED DESCRIPTION

Figure 1:
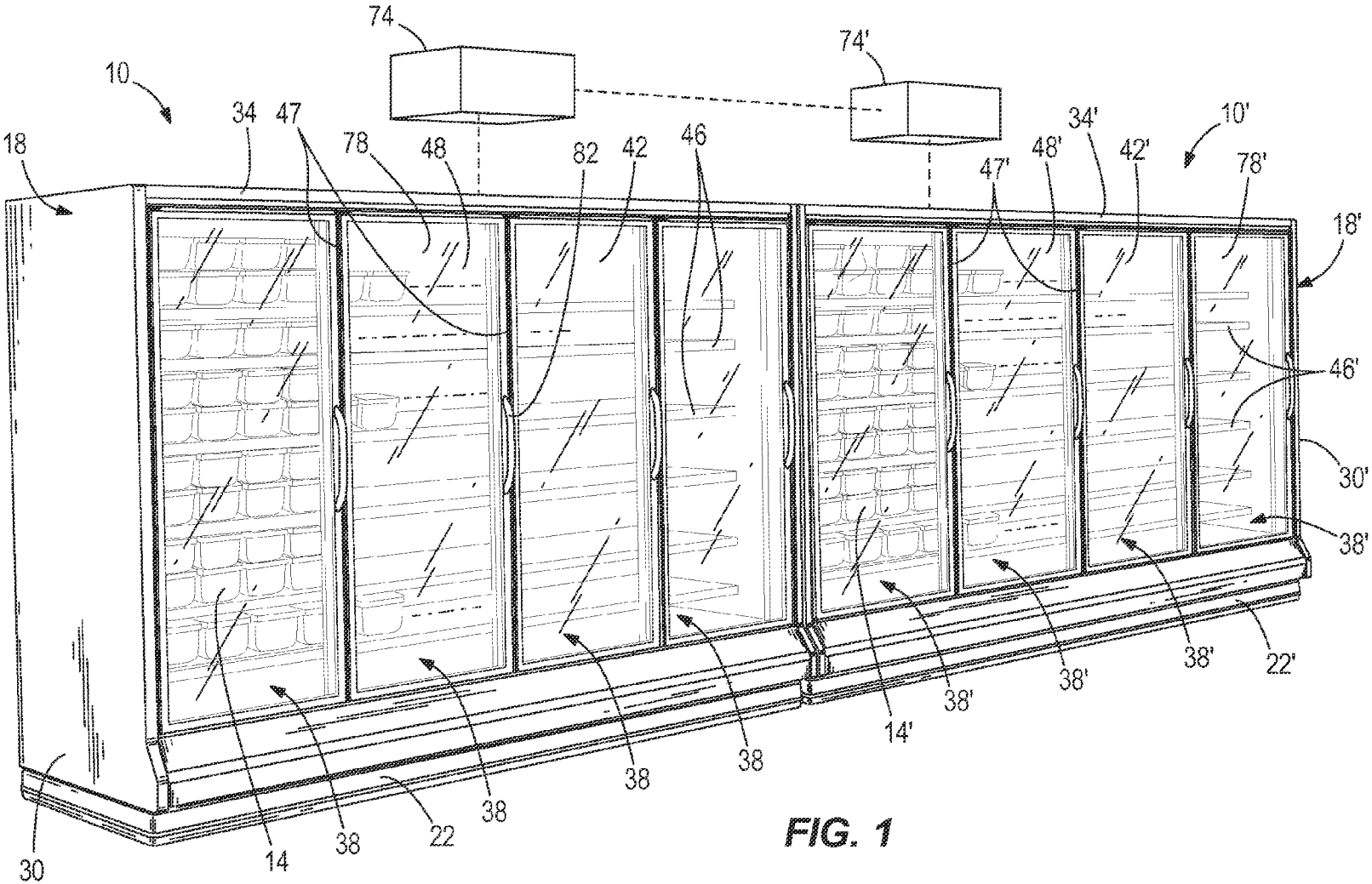
FIG. 1 is a front perspective view of two refrigerated merchandisers embodying the present invention, including a control system associated with each of the refrigerated merchandisers.
Figure 2:
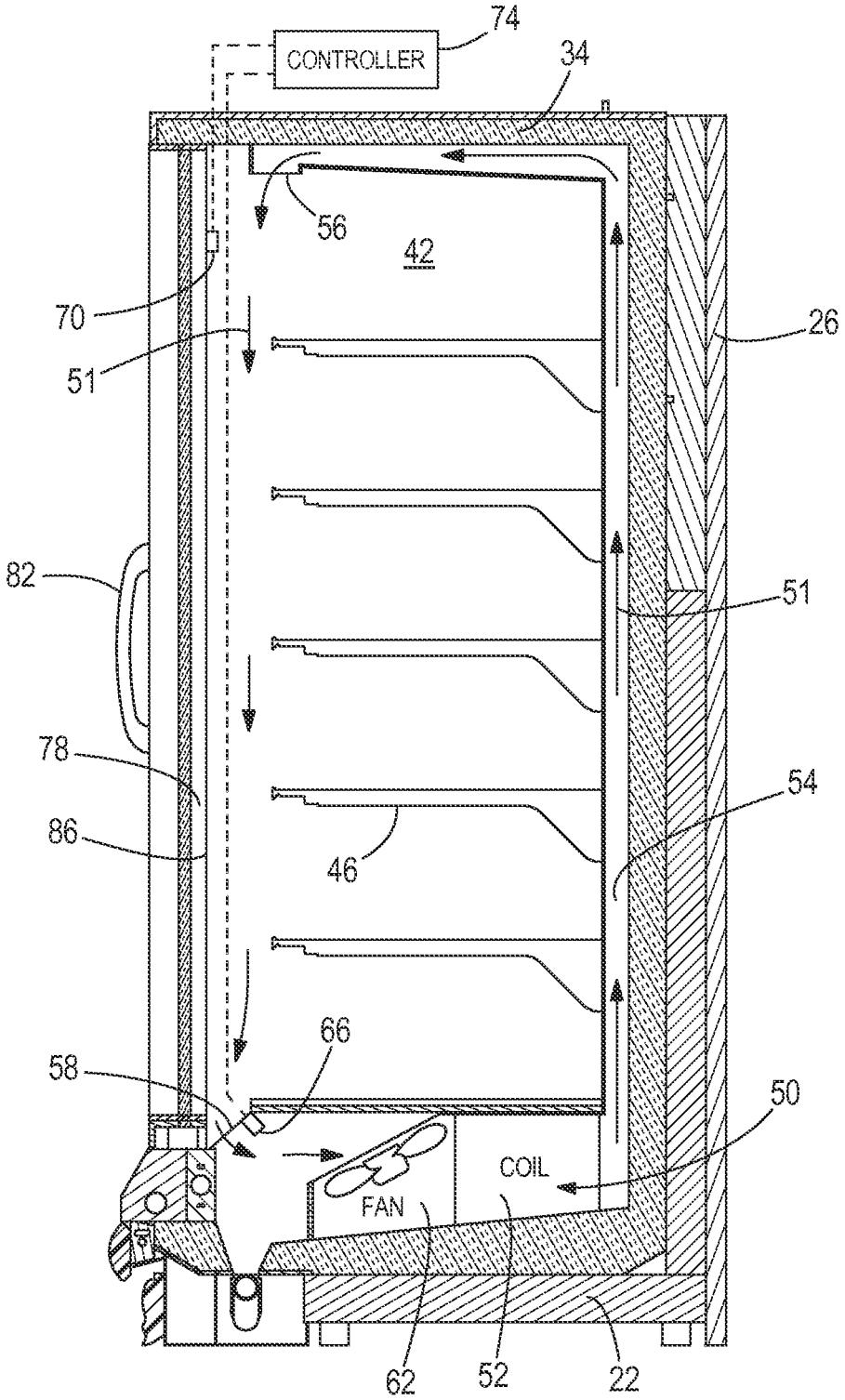
FIG. 2 is a schematic cross-section of one of the refrigerated merchandisers of FIG. 1.

FIGS. 1 and 2 show a refrigerated merchandiser 10 that may be located in a supermarket or a convenience store (not shown) for presenting fresh food, beverages, and other food product 14 to consumers. The merchandiser 10 includes a case 18 that has a base 22, a rear wall 26, side walls 30, a canopy 34, and a plurality of doors 38. The doors 38 are supported by, the case 18, and permit access to the food product 14. The area partially enclosed by the base 22, rear wall 26, side walls 30, and the canopy 34 defines a product display area 42 that supports the food product 14 in the case 18. The food product 14 is displayed on racks or shelves 46 extending forwardly from the rear wall 26, and is accessible by consumers through the doors 38 adjacent the front of the case 18. As shown in FIG. 1, the food product 14 and the shelves 46 are visible behind the substantially transparent doors 38. In the illustrated construction, the refrigerated merchandiser 10 includes four doors 38. In other constructions, the refrigerated merchandiser 10 may include fewer or more doors 38 depending on the size of the case 18

The casing 18 includes vertical mullions 47 that define openings 48 in communication with the product display area 42 to allow access to the food product 14. The mullions 47 are spaced horizontally along the case 18 to provide structural support for the case 18. Each mullion 47 is defined by a structural member that can be formed from a non-metallic or metallic material. The doors 38 are pivotally coupled to the casing 18 over the openings 48, and substantially enclose the product display area 42.

Referring to FIG. 2, at least a portion of a refrigeration system 50 is in communication with case 18 to provide a refrigerated airflow (denoted by arrows 51) to the product display area 42. The refrigeration system 50 includes an evaporator 52 disposed in an air passageway 54 of the case 18, a compressor (not shown), and a condenser (not shown) connected in series with each other. As is known in the art, the evaporator 52 receives a saturated refrigerant that has passed through an expansion valve from the condenser. The saturated refrigerant is evaporated as it passes through the evaporator 52 as a result of absorbing heat from air passing over the evaporator. The absorption of heat by the refrigerant allows the temperature of the air to decrease as it passes over the evaporator 52. The heated or gaseous refrigerant then exits the evaporator 52 and is pumped back to the compressor for re-processing into the refrigeration system 50. The cooled airflow 51 exiting the evaporator 52 via heat exchange with the liquid refrigerant is directed through the air passageway 54 and is introduced into the product display area 42 as an air curtain that maintains the food product 14 at desired conditions.

The airflow 51 is directed downward through the product display area 42 out of an air outlet 56 toward the base 22, where some of the airflow 51 passes through an air inlet 58 (e.g., partially defined by a grill) into the air passageway 54 upstream of the evaporator 52. As illustrated, the portion of the airflow 51 flowing through the air inlet 58 is drawn into the air passageway 54 by a fan 62 located upstream of the evaporator 52. The air inlet 58 and air outlet 56 are both located adjacent the product display area 42.

With continued reference to FIG. 2, the merchandiser 10 includes an air return sensor 66 in communication with at least a portion of the return airflow 51 flowing adjacent the door 38 (e.g., near the air inlet 58). As illustrated, the air return sensor 66 is mounted underneath the grill adjacent the air inlet 58, although other locations are also possible. For example, in some constructions the air return sensor 66 can be mounted on a portion of the refrigeration system 50, or in the air passageway 54 (e.g., coupled to a wall defining the passageway 54). The air return sensor 66 senses a temperature of the return airflow 51 (referred to as an "air return temperature") and generates a signal indicative of the air return temperature.

As shown in FIG. 2, the merchandiser 10 also includes a glass temperature sensor 70. The glass temperature sensor 70 is mounted along an interior portion of the door 38 (e.g. along a glass surface facing the product display area 42). The glass temperature sensor 70 senses a temperature of the door 38 and generates a signal indicative of the temperature of the door 38.

The merchandiser 10 also includes a control system that has a controller 74 to control the temperature of the product display area 42. The controller 74 is in communication with the air return sensor 66 to receive the signal indicative of the air return temperature. The controller 74 is also in communication with the glass temperature sensor 70 to receive the signal indicative of the temperature of the door 38. The controller 74 is located remotely from the case 18, although in some constructions the controller 74 can be coupled to or disposed inside the case 18.

Referring back to FIGS. 1 and 2, each door 38 includes at least one glass panel 78 and a handle 82 to facilitate opening the door 38. The glass panel 78 includes a door heating element 86 in the form of a thin, resistive coating or semi-conductive film that is applied along an interior surface of the glass panel 78 (i.e. the surface of the glass panel 78 facing the product display area 42). In other constructions, the coating can be applied to another surface of the door 38. When activated, the door heating element 86 heats the glass panel 78 to a temperature that is adequate to reduce and/or eliminate any condensation and fogging on the door 38. The glass temperature sensor 70 is positioned along the glass panel 78 to determine any increase in temperature of the glass panel 78 after the door heating element 86 is activated.

Figure 3:
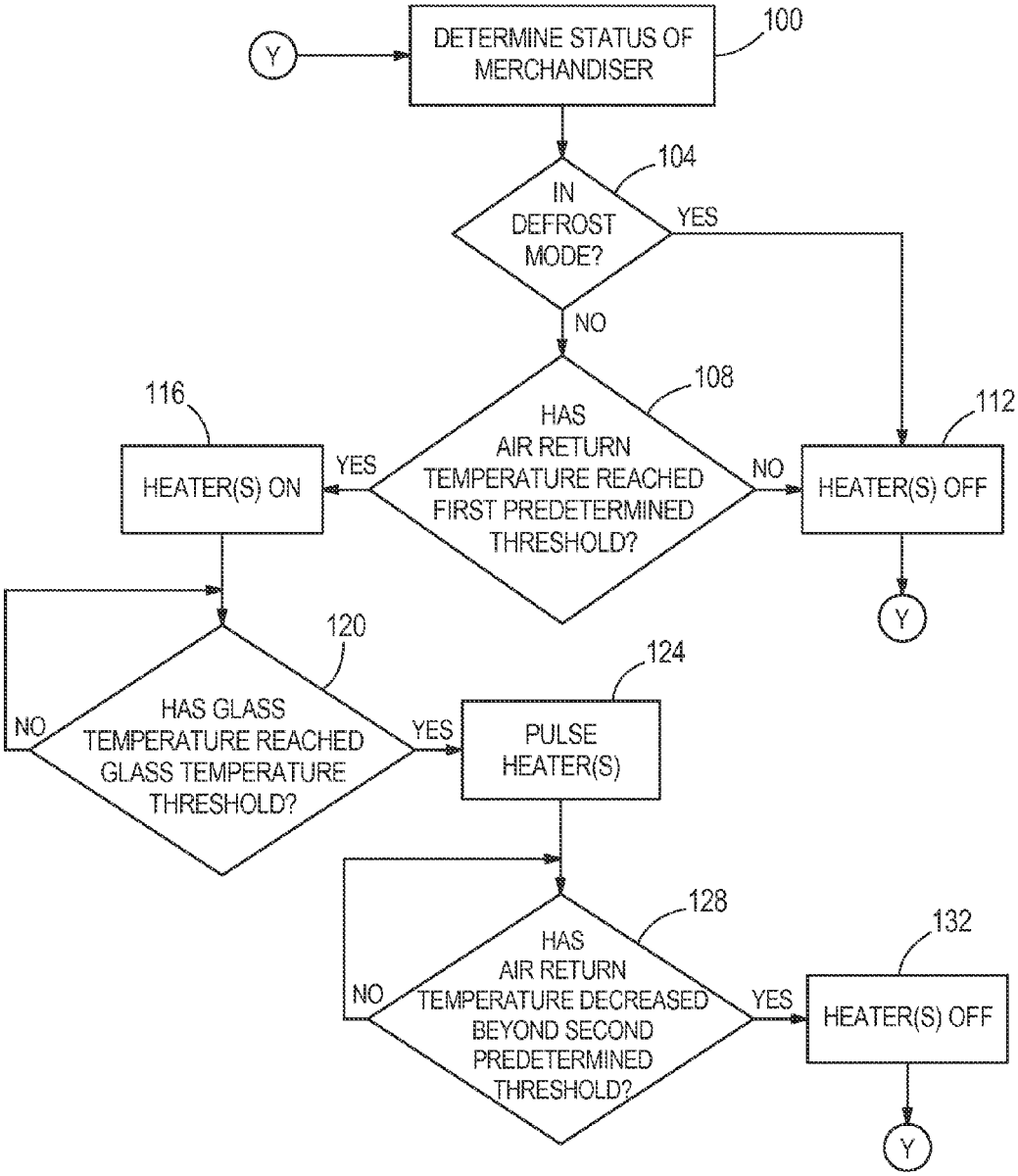
FIG. 3 is flow chart of one construction of a door heating process of the control system for the refrigerated merchandisers.
Figure 4:
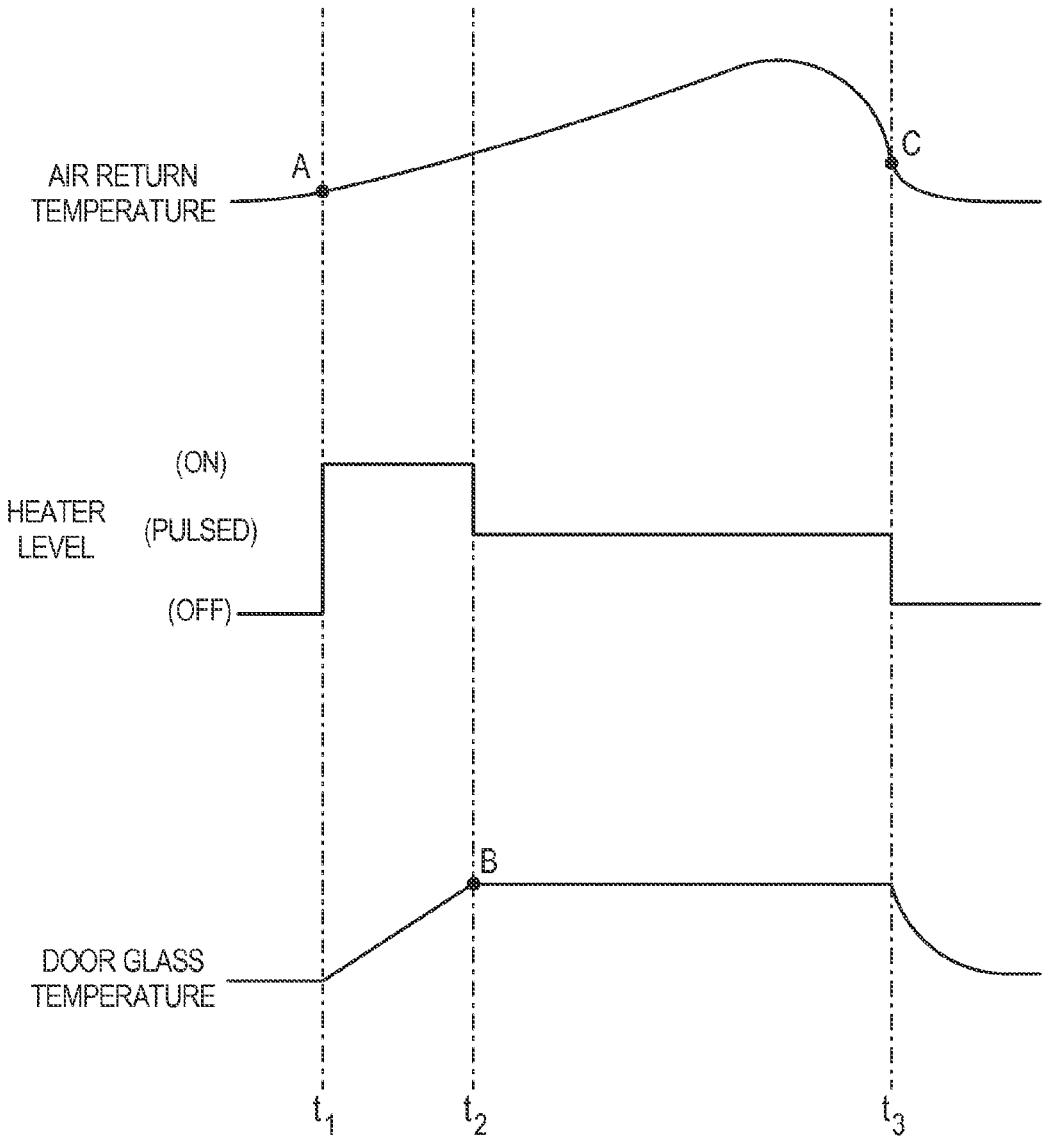
FIG. 4 is a schematic view of the door heating process correlating the air return temperature, the heater level, and the door glass temperature.

FIGS. 3 and 4 show one construction of the control system that selectively initiates a clearing interval for at least one door 38 by activating the door heating element 86 based on the air return temperature of the airflow 51. The controller 74 establishes a baseline temperature value based on signals from the sensor 66 indicative of the air return temperature.

At step 100, the controller 74 determines the status of the merchandiser 10 by determining whether the merchandiser 10 is in use (e.g., turned on). At step 104, the controller 74 determines whether the merchandiser 10 is in a defrost mode. With the control process described with regard to FIG. 3, the merchandiser 10 may undergo periodic defrost (e.g., at night). During defrost, frost build-up on the evaporator 52 is removed or at least reduced, for example, by increasing the temperature of refrigerant flowing through the evaporator 52 or applying heat to the evaporator 52 in other ways (e.g., via a coil heater). The increased refrigerant temperature may cause a rise in the temperature of the airflow passing through the passageway 54 and along the door 38. This rise in temperature typically reaches a threshold such that the door heating element 86 does not need to be activated to remove condensation or fog from the door 38. Moreover, because the defrost mode is commonly initiated during off-peak hours, it is unlikely that the door 38 will be opened, which further reduces the likelihood that condensation will form on the door 38. In view of this, the illustrated controller 74 is programmed to leave the door heating element 86 off at step 108 when the merchandiser defrost mode is activated.

With reference to FIGS. 3 and 4, if the merchandiser 10 is not in the defrost mode (i.e. "No" at step 104), the controller 74 determines whether the return air temperature has reached (e.g., at or above) a first predetermined temperature threshold (point "A" in FIG. 4) at step 108 based on the signal from the air return sensor 66. The first predetermined temperature threshold can be a specific temperature or a temperature range. For example, the first predetermined temperature threshold can be a temperature or range of temperatures between 30° Fahrenheit and 38° Fahrenheit, although the first predetermined temperature threshold can include a temperature outside this range.

The controller 74 compares the temperature from the air return sensor 66 to the first predetermined temperature threshold. In other constructions, the controller 74 can determine whether a change in the air return temperature (e.g., a change of 1° Fahrenheit, 2° F., 3° F., 4° F., 5° F., etc.) over a predetermined time period (e.g., 30 seconds, 1 minute, 2 minutes, 5 minutes, 10 minutes, etc.) has reached (e.g., at or above) a corresponding first predetermined temperature threshold (e.g., 1 to 8° Fahrenheit, etc.). That is, the controller 74 can determine the difference between an initial air return temperature obtained when the door 38 is closed and a second air return temperature obtained when or after the door 38 is opened. The controller 74 selectively activates the door heating element 86 based on the detected change in temperature.

When the door 38 is opened, relatively warm ambient air surrounding the case 18 can enter the product display area 42 and increase the temperature of the airflow 51. The controller 74 determines whether the air return temperature has increased, and if so, whether the temperature has reached the first predetermined temperature threshold. If the air return temperature detected by the sensor 66 has not reached the first predetermined temperature threshold (i.e. "No" at step 108), the controller 74 leaves the door heating element 86 off at step 112. If, on the other hand, the air return temperature is equal to or greater than the first predetermined temperature threshold (i.e. "Yes" at step 108), the controller 74 activates the door heating element 86 at step 116.

With reference to FIG. 4, heat applied to the door 38 by the door heating element 86 (designated as time t1 in FIG. 4) increases the door glass temperature. Between time t1 and a time t2 (e.g., 20 seconds, 30 seconds, 40 seconds, 1 minute, etc.—see FIG. 4), the door glass temperature rises (e.g., linearly) until the door glass temperature has reached (e.g., at or above) a glass temperature threshold (point "B" in FIG. 4, corresponding to time t2). The glass temperature threshold is a temperature at which condensation on the glass panel 78 begins to dissipate. Generally, the glass temperature threshold depends in part on the structural make-up of the door 38. For example, the glass temperature threshold can be any temperature between 55° F. and 70° F., or another temperature outside this temperature range. Generally, the glass temperature threshold is set higher than the anticipated dew point of ambient air surrounding the case 18.

With reference to FIGS. 3 and 4, in step 120, the controller 74 determines whether the glass temperature has reached the glass temperature threshold. In the illustrated construction, the controller 74 waits a predetermined time (e.g., 30 seconds) after the return air temperature reaches the first predetermined threshold temperature to determine the glass temperature from the sensor 70. In some constructions, the controller 74 can determine the glass temperature on a continuous basis or other periodic basis to determine whether the glass temperature threshold has been reached.

The controller 74 switches the door heating element 86 to a pulsed heat mode at step 124 when the glass temperature reaches or exceeds the glass temperature threshold. With reference to FIG. 4, the pulsed heat mode turns on at time t2 and generally maintains the glass temperature at or near the glass temperature threshold until the air return temperature has decreased beyond (e.g., at or below) a second predetermined temperature threshold (point "C" in FIG. 4, corresponding to time t3). The period of time between time t2 and time t3 corresponds to the time that the heating element 86 is pulsed so that the door glass temperature is substantially maintained at the glass temperature threshold. This pulsed heat mode between times t2 and t3 can be controlled by the controller 74 such that the door heating element 86 is "on" for a first period of time, "off" for a second period of time, and repeating this pulsed cycle until the controller 74 receives a signal from the air return sensor 66 that the air return temperature has decreased beyond the second predetermined temperature threshold.

With continued reference to FIGS. 3 and 4, at step 128 the controller 74 determines whether the air return temperature has decreased beyond the second predetermined temperature threshold. The second predetermined temperature threshold can be a temperature or range of temperatures between 30° Fahrenheit and 38° Fahrenheit, although the second predetermined temperature threshold can include a temperature outside this range. In some constructions, the second predetermined temperature threshold can be the same or approximately the same temperature as the first predetermined temperature threshold. When the controller 74 determines that the air return temperature has decreased beyond the second temperature threshold (i.e. "Yes" at step 128), the door heating element 86 is turned off at step 132. The process then returns to step 100. As illustrated in FIG. 4, the door heating element 86 is turned off at time t3, resulting in a decrease in the door glass temperature due at least in part to the refrigerated environment within the merchandiser 10 and the heating element 86 being turned off. The time between t1 and t3 is an overall clearing interval that is controlled by the controller 74.

In some constructions, the pulsed heat mode can be used to keep the glass temperature at the glass temperature threshold for a predetermined period of time regardless of whether the air return temperature has decreased beyond the second predetermined temperature threshold. For example, after the air return temperature has reached the first predetermined temperature threshold and the glass temperature threshold has also been reached, the controller 74 can operate the heating element 86 in the pulsed heat mode for a predetermined time period (e.g., ten minutes) to clear the glass panel 78 of any condensation. Other time periods above or below ten minutes are also possible and considered herein.

In some constructions, the merchandiser 10 may be provided without the glass temperature sensor 70. In these constructions, the controller 74 can be programmed to run the door heating element 86 for a first predetermined time period (e.g., 30 seconds) after the controller 74 determines that the door heating element 86 should be turned on to clear condensation as described above. After the first predetermined time period has elapsed, the controller 74 can run the door heating element 86 on in the pulsed heat mode for a second predetermined time period (e.g., 10 minutes). The first predetermined time period can correspond to a time period that is generally needed to increase the temperature of the door 38 to the glass temperature threshold. The second predetermined time period can correspond to a time period that is generally needed to eliminate all, or substantially all, of the condensation on glass panel 78 while the temperature of the glass panel 78 is generally held constant at or very close to the glass temperature threshold.

With continued reference to FIGS. 1-4, the controller 74 not only activates the door heating element 86 associated with the door 38, but also activates the door heating elements 86 on adjacent doors 38. For example, if the merchandiser 10 is not in the defrost mode and the controller 74 receives a signal from the return air sensor 66 indicative of the return airflow reaching the first predetermined temperature threshold, the controller 74 activates the door heating element 86 associated with that particular door 38 and also activates the door heating element(s) 86 on at least one adjacent door 38. The door heating elements 86 on both doors 38 are activated simultaneously.

After the air return temperature has decreased beyond the second predetermined temperature threshold, the previously activated door heating elements 86 are turned off. In this manner, the door 38 that is opened and causing condensation to form on the interior of the glass panel 78 and the at least one adjacent door 38 are cleared of condensation when the return sensor 66 associated with the primary door indicates a rise in the air return temperature. That is, each of the heating elements 86 on the primary door 38 and the adjacent door(s) 38 are turned on (and remain on until the air return temperature decreases to the second predetermined temperature threshold) even if the air return sensor 66 for the adjacent door 38 does not sense an increased air return temperature.

Additionally, the process described in FIGS. 3 and 4 also applies across partial or entire lineups of merchandisers 10. With reference to FIG. 1, an additional merchandiser 10' is positioned adjacent (e.g., connected to) the merchandiser 10 and includes the same components as merchandiser 10. As illustrated, each of the refrigerated merchandisers 10, 10' has an associated controller 74, 74' that are in communication with each other so that the controller of merchandiser 10 can send and receive signals relative to the controller 74', and the controller 74' can send and receive signals relative to the controller 74 such that both merchandisers 10, 10' can be controlled based on detection of the air return temperature increasing to the first predetermined temperature threshold. For example, when the controller 74 is not controlling the merchandisers 10, 10' in the defrost mode and the controller 74 receives a signal from an return air sensor 66 located adjacent an end door 38 (i.e. the door 38 positioned farthest away from view in FIG. 1), the controller 74 can send a signal to the controller 74' to activate the door heating element 86' on the end door 38' located nearest in view in FIG. 1 (i.e. at the near end of the merchandiser 10'). As will be appreciated by one of ordinary skill in the art, other door heating scenarios are also possible and considered herein.

After the air return temperature has decreased beyond the second predetermined temperature threshold for the end door 38, any door heating elements 86, 86' that have been activated and pulsed are turned off on the doors 38, 38'. This enables the primary door 38 and other doors 38 directly and/or indirectly adjacent the primary door 38 to be cleared of condensation when the air return sensor 66 associated with the primary door 38 indicates a rise in air return temperature regardless of whether the adjacent door(s) 38 are on the merchandiser 10 or on the merchandiser 10'. Thus, as long as the air return sensor 66 for the primary door 38 senses the increased air return temperature each of the door heating elements 86, 86' can turned on and pulsed until the air return temperature for the temperature of the primary door 38 has decreased beyond the second predetermined temperature threshold even if an air return sensor 66' for the adjacent door 38' does not sense an increased air return temperature.

Various features and advantages of the invention are set forth in the following claims.

The invention claimed is:

1. A refrigerated merchandiser comprising:

a case defining a product display area and including a base having an air inlet located adjacent the product display area and a canopy disposed substantially above the product display area, the canopy having an air outlet located adjacent the product display area, the case further including a mullion defining an opening in communication with the product display area;

a door coupled to the case over the opening to provide access to the product display area and to substantially enclose the product display area, the door including a glass member having a conductive film;

a passageway fluidly connecting the air inlet with the air outlet to direct a refrigerated airflow from the air outlet across the opening and generally toward the air inlet;

a first sensor coupled to the case adjacent the air inlet and in communication with a portion of the refrigerated airflow passing through the air inlet to sense a temperature of the airflow and to generate a signal indicative of an air return temperature;

a second sensor; and a controller in communication with the first sensor to receive the signal indicative of the air return temperature and in communication with the second sensor to receive the signal indicative of the glass temperature, the controller further in communication with the conductive film and programmed to initiate a clearing interval to clear condensation from the door in response to the signal indicative of the air return temperature reaching a first predetermined temperature threshold, wherein the controller is programmed to heat the door until the second sensor detects that the glass temperature has reached a glass temperature threshold.

2. The refrigerated merchandiser of claim 1, wherein the door is a first door and the case further includes a second door positioned adjacent the first door and a conductive film disposed on the adjacent door, wherein the controller is programmed to heat the door and the adjacent door in response to the signal from the first sensor indicative of the air return temperature reaching the first predetermined temperature threshold.

3. The refrigerated merchandiser of claim 1, wherein the conductive film is coupled to an interior surface of the glass member facing the product display area.

4. The refrigerated merchandiser of claim 1, wherein the first sensor is mounted beneath an air intake grill.

5. The refrigerated merchandiser of claim 1, wherein the controller is further programmed to pulse heat applied to the door in response to the second sensor detecting that the glass temperature has reached the glass temperature threshold.

6. The refrigerated merchandiser of claim 5, wherein the controller is programmed to maintain the glass temperature at the glass threshold temperature in response to the second sensor detecting that the glass temperature has reached the glass temperature threshold.

7. The refrigerated merchandiser of claim 1, wherein the controller is programmed to stop the clearing interval in response to the air return temperature for the first door decreasing beyond a second air threshold temperature.

8. The refrigerated merchandiser of claim 7, wherein the first predetermined temperature threshold is between approximately 30-38° Fahrenheit.

9. The refrigerated merchandiser of claim 7, wherein the second predetermined temperature threshold is between approximately 30-38° Fahrenheit.

10. The refrigerated merchandiser of claim 7, wherein the glass temperature threshold is between approximately 55-70° Fahrenheit.

11. A method of operating a refrigerated merchandiser including a case defining a product display area, and at least one door providing access to the product display area, the method comprising:

sensing an air return temperature inside the case via a first sensor positioned adjacent an air return inlet of the case and in fluid communication with at least a portion of a refrigerated airflow passing through the air inlet;

generating a signal indicative of the air return temperature via the first sensor;

determining whether the signal is indicative of the air return temperature reaching a first predetermined temperature threshold via a controller in communication with the first sensor; and initiating a clearing interval via the controller to clear condensation from the door in response to the signal indicating that the air return temperature has reached the first predetermined temperature threshold;

sensing a glass temperature of the door via a second sensor;

generating a signal indicative of the glass temperature via the second sensor; and controlling the clearing interval based on the glass temperature signal.

12. The method of claim 11, wherein initiating the clearing interval includes pulsing the heat applied to the door.

13. The method of claim 11, wherein the door is a first door and the case further includes a second door positioned adjacent the first door, the method further including initiating a clearing interval on the adjacent door in response to the signal indicative of the air return temperature reaching the first predetermined temperature threshold.

14. The method of claim 11, further comprising:

continuously heating a surface of a door at least partially enclosing the product display area in response to the signal indicative of the air return temperature reaching the first predetermined temperature threshold;

sensing the glass temperature on the door and generating the signal indicative of the glass temperature;

pulsing the heat applied to the surface of the door in response to the glass temperature reaching a glass threshold temperature; and initiating a clearing interval on a second door positioned adjacent the first door.

15. The method of claim 14, wherein initiating the clearing interval on the second door includes continuously heating the second door in response to the signal indicative of the air return temperature reaching the first predetermined temperature threshold.

16. The method of claim 15, further comprising pulsing the heat applied to a surface of the second door in response to the glass temperature reaching the glass threshold temperature.

17. The method of claim 16, further comprising simultaneously initiating the clearing interval on the first door and the second door.

18. A method of operating a refrigerated merchandiser including a case defining a product display area, and at least one door providing access to the product display area, the method comprising:

sensing an air return temperature inside the case;

generating a signal indicative of the air return temperature;

determining whether the signal is indicative of the air return temperature reaching a first predetermined temperature threshold; and initiating a clearing interval to clear condensation from the door in response to the signal indicating that the air return temperature has reached the first predetermined temperature threshold, wherein initiating a clearing interval includes raising a temperature of the door to a glass threshold temperature, and maintaining the temperature of the door at the glass threshold temperature for a predetermined period of time.

* * * * *